US005420649A

United States Patent [19]

Lewis

[11] Patent Number: 5,420,649

[45] Date of Patent: May 30, 1995

[54] DIVING MASK WITH IMPROVED FIELD OF VISION

[76] Inventor: John E. Lewis, 4524 Palos Verdes Dr. East, Rancho Palos Verdes, Calif. 90274

[21] Appl. No.: 93,186

[22] Filed: Jul. 16, 1993

[51] Int. Cl.[6] ..... G02C 1/00

[52] U.S. Cl. ..... 351/43; 351/41; 2/430

[58] Field of Search ..... 351/41, 43, 158; 2/428, 2/430, 447

[56] References Cited

U.S. PATENT DOCUMENTS

| | | | |
|---|---|---|---|
| 2,594,698 | 4/1952 | Thomas | 88/1 |
| 3,672,750 | 6/1972 | Hagen | 351/43 |
| 3,899,244 | 8/1975 | Mulder | 351/43 |
| 3,944,345 | 3/1976 | Decorato | 351/43 |
| 4,468,819 | 9/1984 | Ohno | 351/43 |
| 4,704,014 | 11/1987 | Carner, Jr. | 351/43 |
| 4,717,249 | 1/1988 | Fischer | 351/43 |
| 5,170,190 | 12/1992 | Berke | 351/43 |
| 5,216,454 | 6/1993 | Berke | 351/43 |
| 5,274,405 | 12/1993 | Webster | 351/158 |
| 5,345,615 | 9/1994 | Garofalo | 2/430 |

FOREIGN PATENT DOCUMENTS 0242221 9/1990 Japan ..... 351/41

OTHER PUBLICATIONS

Advertisement from p. 14 of *Scuba Times,* Jul./Aug. 1993 issue.

Weldman et al., "Visual Fields of the Scuba Diver," *Human Factors,* 7, 423–430, 1965.

*Primary Examiner*—William L. Sikes
*Assistant Examiner*—Huy Mai
*Attorney, Agent, or Firm*—Christie, Parker & Hale

[57] ABSTRACT

A diving mask has a body for sealably engaging a wearer's face. The mask has one or more transparent viewing plates supported by the body, each having inner and outer surfaces. One or more prisms or simply curved lenses are affixed to the viewing plates to improve the diver's field of vision. A pair of horizontally oriented prisms or lenses may be mounted to a front viewing plate below the diver's normal view plane to provide a field of view directed downward toward the diver's body so as to provide a self-inspection capability. Vertically oriented prisms or lenses may be mounted on front and side plates to produce an enhanced and substantially continuous horizontal peripheral field of view.

38 Claims, 15 Drawing Sheets

DIVING MASK WITH IMPROVED FIELD OF VISION

FIELD OF THE INVENTION

The invention pertains to masks for underwater use. More particularly, it pertains to a diving mask with an enhanced field of view.

BACKGROUND OF THE INVENTION

There are presently a wide variety of masks that are designed for use by sport divers. In their present form, many such diving masks are closely analogous to "blinders" on a horse, narrowing the horizontal field of view and similarly restricting the vertical field of view. Additionally, the refractive properties of the ambient water further narrow the diver's field of view through the front port of the mask. As a result, many things of interest to the diver go unobserved. In particular, conventional masks do not allow a diver to easily see the straps or controls of his buoyancy compensator, let alone his weight belt or anything attached to it. This limitation is more than an inconvenience. If the diver becomes entangled in heavy monofilament fishing line, kelp, etc., the lack of easy self-inspection can be dangerous, particularly for an inexperienced diver.

Some masks have a greater field of view than others, but, as shown by the experiments of Weldman et al. ("Visual Fields of the Scuba Diver," Weldman, G., Christianson, R. A., and Egstrom, G. H., *Human Factors* 7, 423–430, 1965), few have a total horizontal field of view greater than about 80°. In order to mitigate this restriction, masks with side glass panels were introduced that provide approximately an additional 25° of view directly to the sides of the diver. Also, as is described below in greater detail, when side panels are used, gaps of about 25° are present between the diver's field of vision through the front and side ports.

A common element of virtually all diving masks is a flat front port of a transparent material, which is commonly a tempered glass plate. The glass and water both have indices of refraction greater than that of air, and this is a major source of the restriction in the diver's field of vision. Although the glass port is necessary to provide an air interface with the diver's eyes, the glass itself plays a minor role in determining the underwater field of vision.

FIG. 1*a* illustrates the refraction of a light ray passing from water through a flat glass port into air. Under Snell's Law:

$$n_{air} \sin \Theta_{air} = n_{glass} \sin \Theta_{1\ glass}$$

$$n_{glass} \sin \Theta_{2\ glass} = n_{water} \sin \Theta_{water}$$

where $n_{air}$ $n_{water}$ and $n_{glass}$ are the indices of refraction of air, water and glass, respectively, and $\Theta_{air}$, $\Theta_{water}$ and $\Theta_{glass}$, are the angles of the light ray off of the respective boundary normals within air, water and glass, respectively.

Because the surfaces of the port are both flat and parallel, the internal angles of the light ray at both surfaces of the glass port are the same ($\Theta_{1\ glass} = \Theta_{2\ glass} = \Theta_{glass}$) and thus, other than creating a minor displacement (less than the thickness of the port), the port plays no role in determining the optical path. Accordingly, the equations combine:

$$n_{air} \sin \Theta_{air} = n_{water} \sin \Theta_{water}$$

with the angle in water independent of the index of refraction of the glass port.

Thus, the viewing angle in water may be calculated as a function of the initial angle in air without regard to the particular transparent material used for the port ($n_{air} = 1.00$ and, for sea water at 20° C., $n_{water} = 1.34$). The results of these calculations are presented in Table 1:

TABLE 1

| $\Theta_{air}$ (deg) | $\Theta_{water}$ (deg) |
|---|---|
| 0 | 0 |
| 10 | 7.5 |
| 20 | 14.8 |
| 30 | 21.9 |
| 40 | 28.7 |
| 50 | 34.9 |
| 60 | 40.3 |
| 70 | 44.5 |
| 80 | 47.3 |
| 90 | 48.3 |

It can thus be seen that no matter how close the port is to the eyes or how extensive the port is, the line of sight in water has a fundamental limitation to less than 49°. The resultant total lateral field of view in water is less than 97°.

When light rays pass through a prism or simply curved lens, the two faces of glass are not parallel but are at an angle to each other, and the calculations are slightly altered. As shown in FIG. 1*b*, two surfaces through which a light ray passes are separated by an angle $\Theta_P$, shown as the included angle of a triangular-section prism. As is known from Snell's Law:

$$n_{air} \sin \Theta_{air} = n_{glass} \sin \Theta_{1\ glass}$$

$$n_{glass} \sin \Theta_{2\ glass} = n_{water} \sin \Theta_{water}$$

Furthermore, geometrically:

$$\Theta_{2\ glass} = \Theta_{1\ glass} + \Theta_P$$

It can accordingly be seen that, given $\Theta_P$, $n_{glass}$ and $\Theta_{air}$, the equations may be solved for $\Theta_{water}$. Similarly, for a given deflection of the view line ($\Theta_{water} - \Theta_{air} - \Theta_P$), the equations may be solved to determine $\Theta_P$ and $n_{glass}$ or vice versa.

By example, if $\Theta_{air} = 0$, then $\Theta_{1\ glass} = 0$ and:

$$\Theta_{2\ glass} = \Theta_P$$

$$n_{water} \sin \Theta_{water} = n_{glass} \sin \Theta_P$$

Solving for $\Theta_{water}$:

$$\Theta_{water} = \sin^{-1} ((n_{glass}/n_{water}) \sin \Theta_P$$

Similarly, solving for $\Theta_P$:

$$\Theta_P = \sin^{-1} ((n_{water}/n_{glass}) \sin \Theta_{water})$$

If geometry constraints dictate $\Theta_P$, the equation can be solved for the necessary index of refraction to achieve a certain $\Theta_{water}$:

$$n_{glass} = n_{water} (\sin \Theta_{water} / \sin \Theta_P)$$

Vertical Line of Sight and Self-Inspection

As shown schematically in FIG. 2, for a typical mask, the maximum downward internal viewing angle $\Theta_{air}$ (from the eyes of the wearer to the base of the front port) is approximately 55°. The corresponding maximum downward viewing angle in water $\Theta_{water}$ is therefore 37.7°, an angle that precludes a direct view of the diver's upper body or any equipment attached to it.

Horizontal Peripheral Field of View

As shown schematically in FIG. 3*a*, a typical mask has a maximum internal lateral viewing angle $\Theta_{air}$, to each side which is limited by the width of the mask and forward distance from the eyes of the wearer to about 55°. The maximum external lateral viewing angle $\Theta_L$ is therefore approximately 37.7° and the resulting total lateral field of view in water $2\Theta_L$ is less than about 76°.

In an attempt to increase the diver's field of view, side glass ports that are orthogonal to the front port have been added to some masks. Assuming no structure separates the front and side ports, the forward-most internal viewing angle through the side port would be about 35° and, therefore, the corresponding viewing angle in water $\Theta_S$ equals approximately 25.3°. Accordingly, a blind spot or gap having an angle $\Theta_G$ equal to about 27° is formed between the front view section and each side view section. Thus, although the resultant total field of view has been increased by approximately 54°, remaining 27° gaps are formed in important zones of peripheral vision. It can be seen that in an actual mask, the presence of a frame structure between the front and side ports has the effect of separating the outboard most internal view line to the front port and the forward most internal view line to the side port, thereby increasing the gap angle $\Theta_G$.

A partial design solution is to simply rotate the side ports by approximately 35°, as illustrated in FIG. 3*b*, which rotates the side port field of view to a more forward looking position. However, while this reduces the forward looking gaps from 27° to about 17.3° the external rear most view lines through the side ports have been rotated forward thus reducing the maximum peripheral view.

U.S. Pat. No. 5,170,190, by Joseph J. Berke, discloses a diving mask which uses principles of reflection to provide a view which is either substantially upward or downward of the diver's normal view plane. Specifically, one or more prisms having reflectorized surfaces are placed directly in the diver's forward line of sight along the normal view plane. In an upward view enhancing embodiment, an incident light ray passes through a first transparent substantially upwardly facing prism face, is reflected off a second substantially downwardly facing mirrored face and back to the eye of the wearer through a third rear facing face. The prism may be configured to provide an intermediate internal reflection off the first face. The device blocks the normal field of vision, replacing it with the specific upward or downward field provided by the reflection.

U.S. Pat. No. 4,717,249, by Bernard Fischer, discloses a mask wherein a convex lens is affixed to the outer surface of the mask to provide a magnified view of instruments such as watches and gages. The lens has an outwardly facing spherical surface and a planar surface affixed to the front of the face plate. The chord of the spherical surface is oriented at an angle to the planar surface. Accordingly, the lens may be located below the normal view plane and laterally separated from a forward view line so that the line of sight through the center of the lens is directed to the wearer's eye. Acting as a magnifying glass, the design provides a limited depth of focus. Accordingly, the instrument to be viewed must be brought to a fixed location in front of the lens.

In view of the foregoing, it can be seen that there is a need for a diving mask with an enhanced downward view so as to facilitate self-inspection by the wearer. The mask should provide a self-inspection field of view which has a sufficient in focus depth for an accurate view of the diver's body and equipment and which does not interfere with the diver's normal forward view. There is, furthermore, a need for a diving mask which eliminates lateral blind spots and provides an enhanced substantially continuous horizontal field of view forward and to the sides.

SUMMARY OF THE INVENTION

There is accordingly provided in practice of the invention, a diving mask which provides the wearer with an increased field of vision without blocking the viewer's normal forward field of view. In a preferred embodiment, the mask includes a body for sealably engaging a wearer's face and includes one or more transparent viewing plates supported by the body, each having inner and outer surfaces. The mask incorporates one or more transparent refracting bodies each having a first planar surface and a second simply curved surface, which is at least in part at an acute angle to the first surface, for refractively altering the wearer's field of view. The refracting bodies may comprise prisms (wherein the second surface has an infinite radius of curvature) or singly curved lenses (which may have a constant radius of curvature).

BRIEF DESCRIPTION OF THE DRAWINGS

These and other features, aspects, and advantages in the present invention will be more fully understood when considered with respect to the following detailed description, appended claims and accompanying drawings, wherein:

DETAILED DESCRIPTION

Figure 1A:
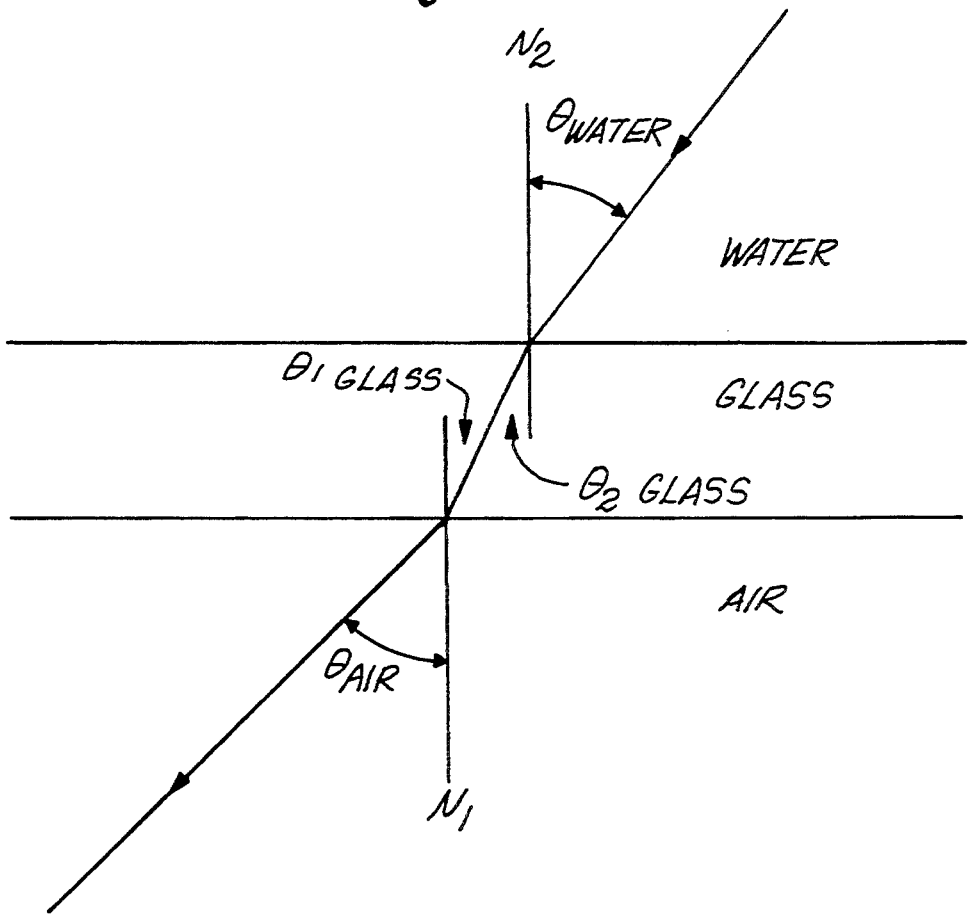
FIG. 1*a* is a diagram of a light ray passing between water and air through a flat glass plate.
Figure 1B:
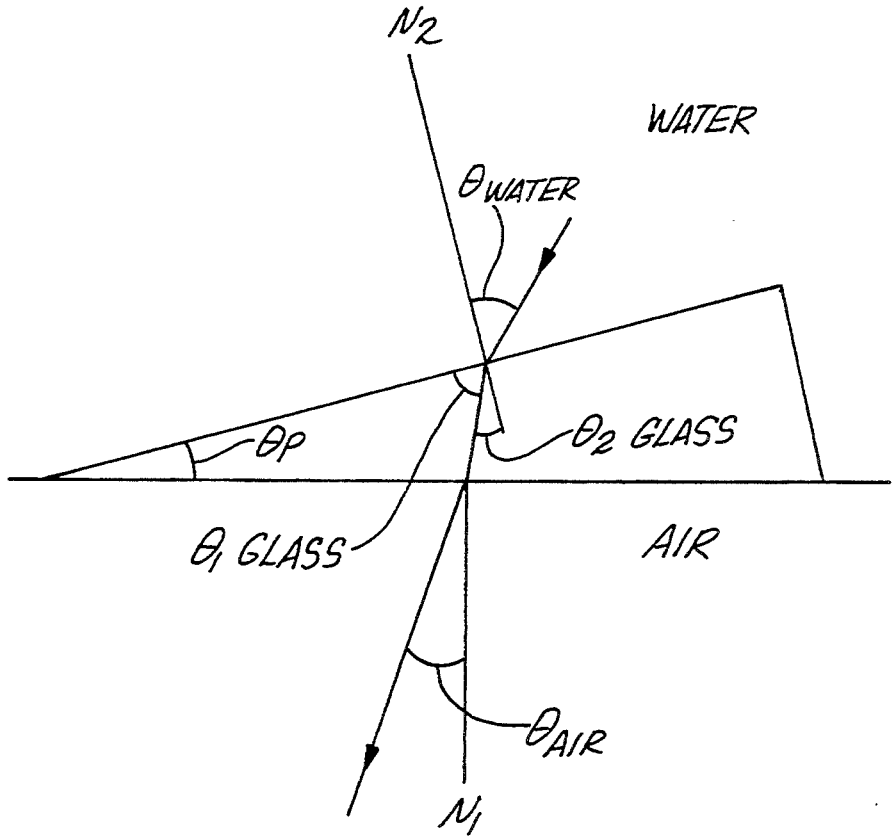
FIG. 1*b* is a diagram of a light ray passing between water and air through a prism.
Figure 2:
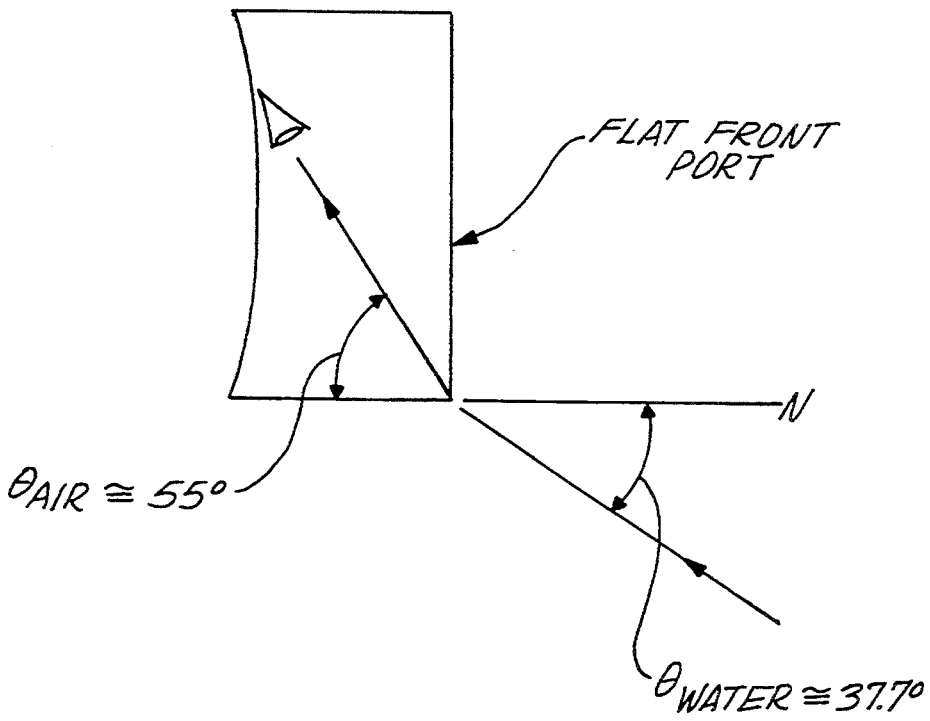
FIG. 2 is a side view diagram of a typical diving mask, showing the passage of light rays through the ambient water and captive air to the eyes of the wearer.
Figure 3A:
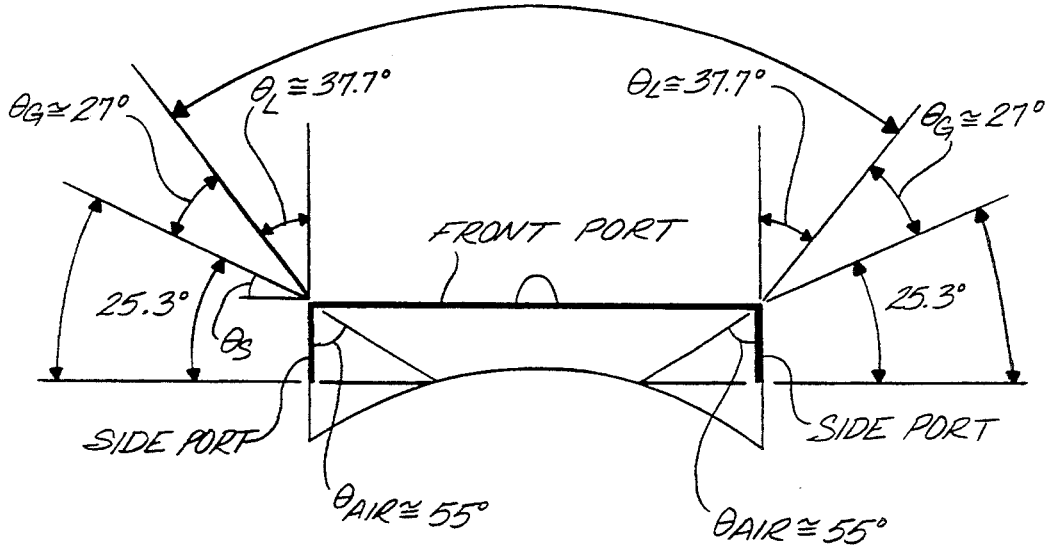
FIG. 3*a* is a top view diagram of a typical diving mask, showing the passage of light rays through the ambient water and captive air to the eyes of the wearer.
Figure 3B:
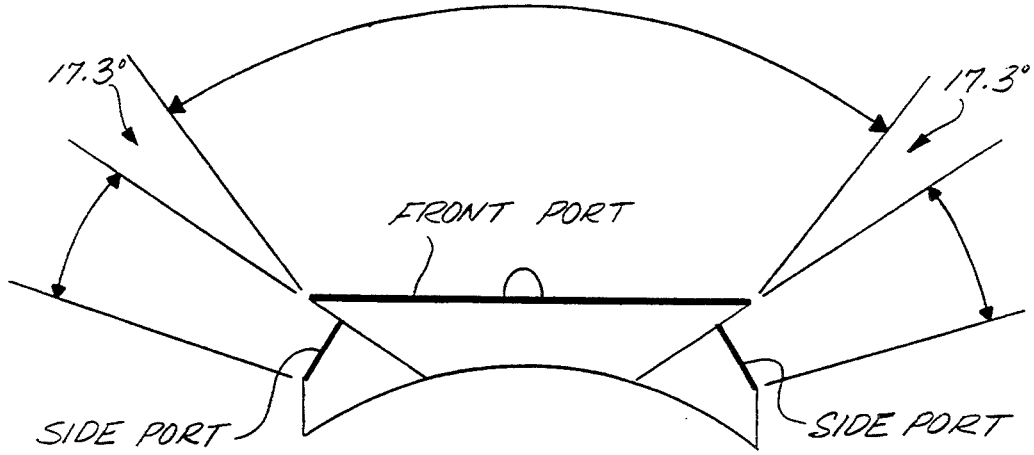
FIG. 3*b* is a top view diagram of a diving mask having tilted side ports, showing the passage of light rays through the ambient water and captive air to the eyes of the wearer.
Figure 4:
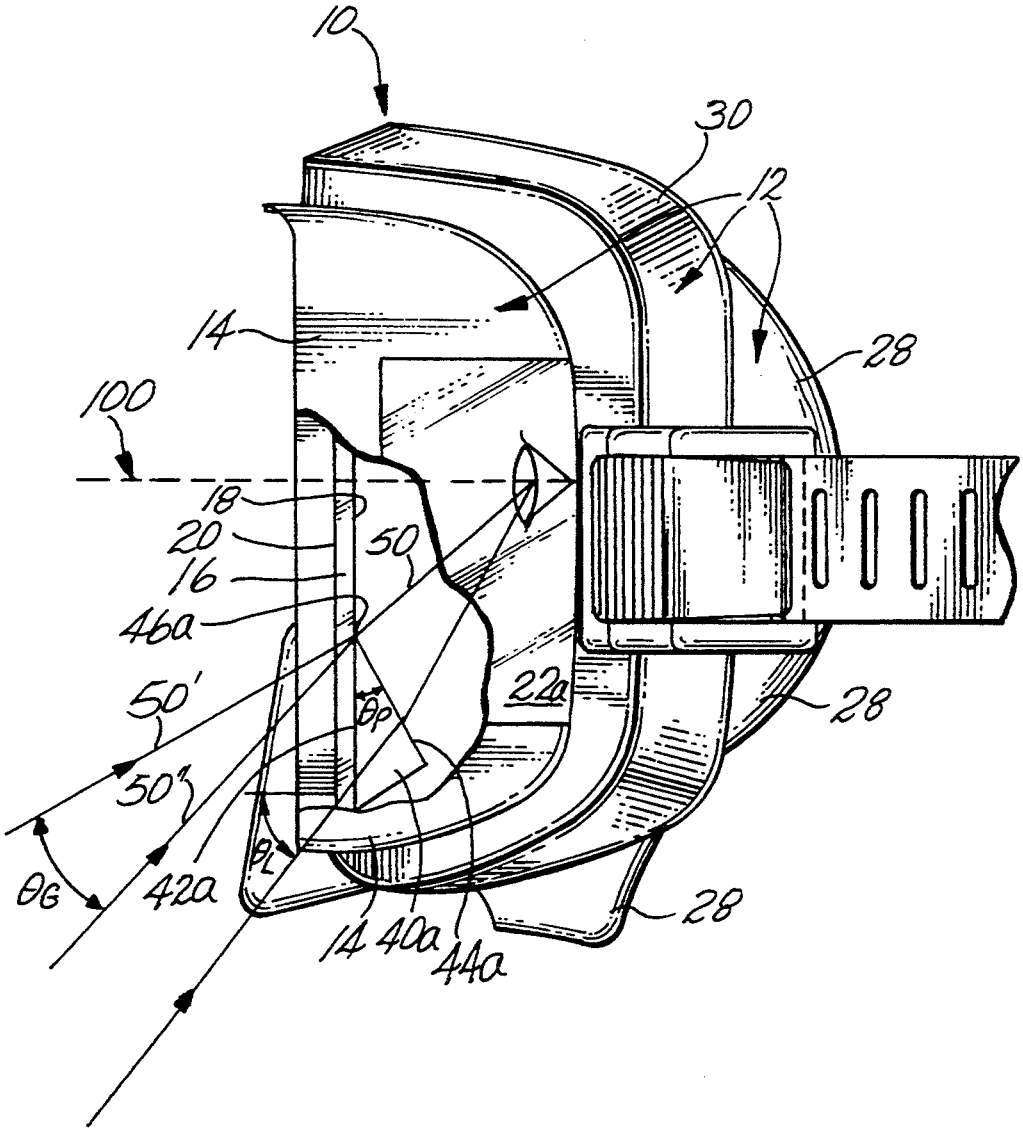
FIG. 4 is a semi-schematic partial side cutaway view of a diving mask featuring a self-inspection prism according to principles of the present invention.
Figure 5:
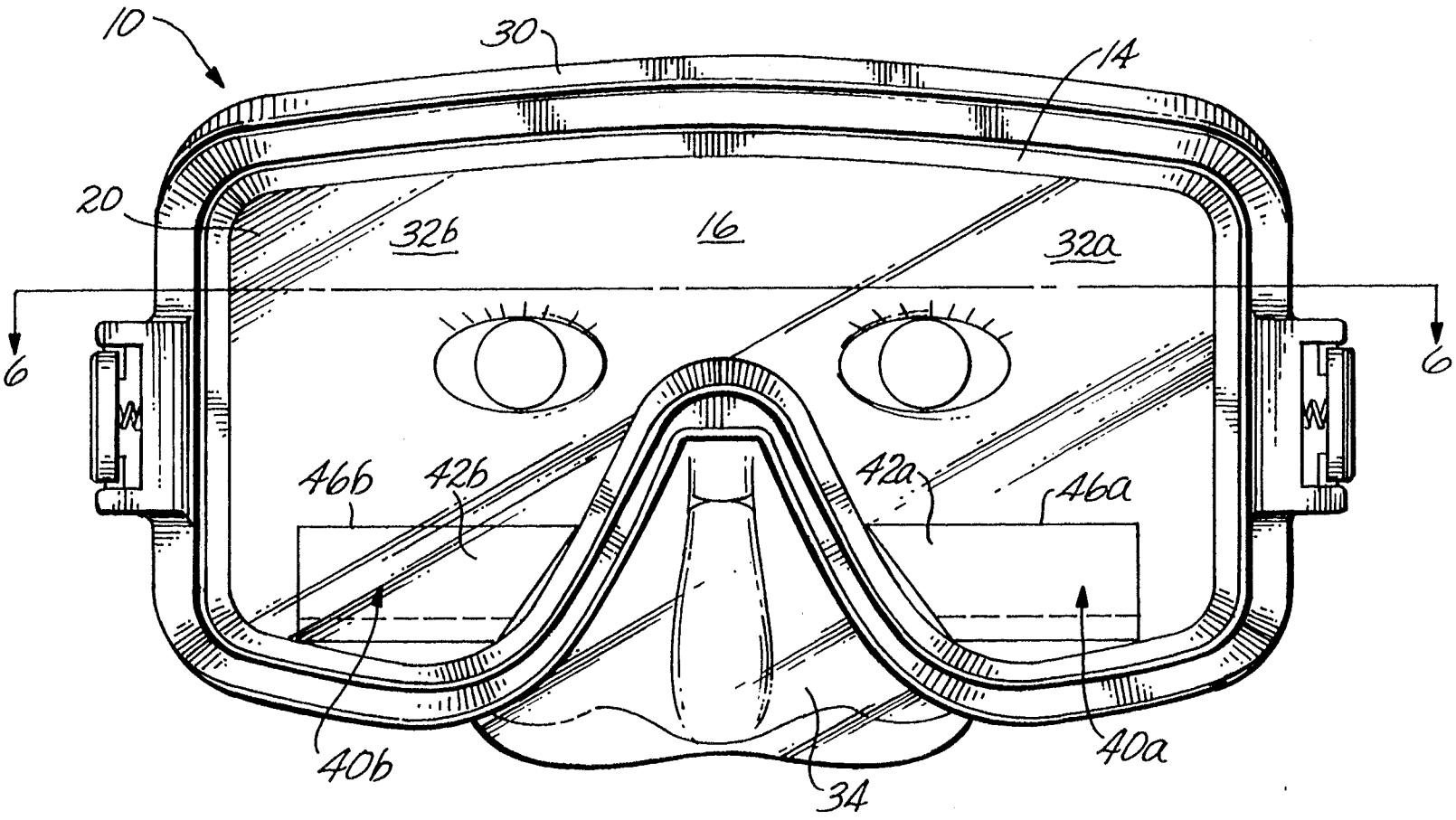
FIG. 5 is semi-schematic a front elevational view of the mask of FIG. 4.
Figure 6:
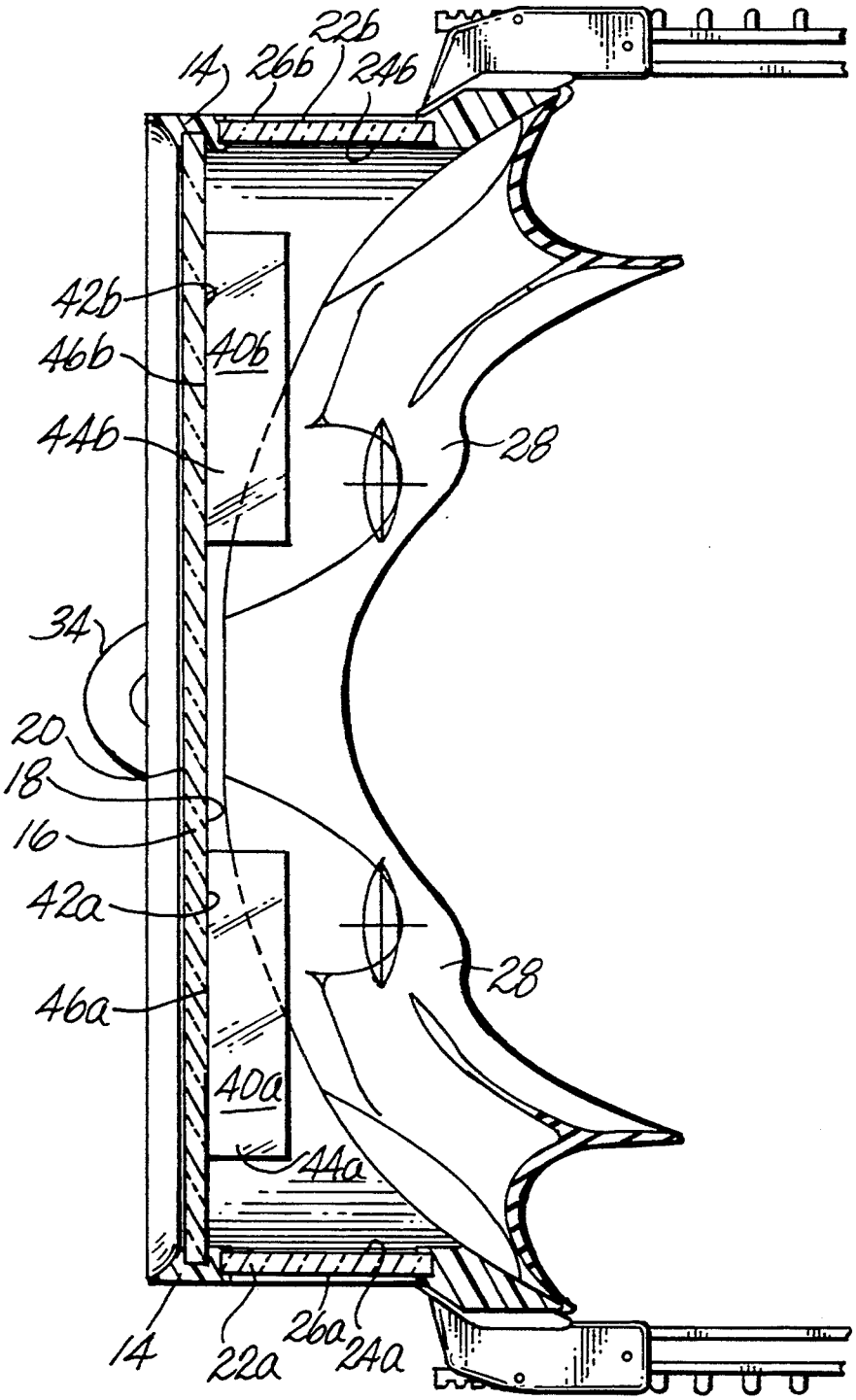
FIG. 6 is a semi-schematic top cross-sectional view of the diving mask of FIG. 5 taken along line 6—6.

Referring to FIGS. 4, 5 and 6, there are shown semi-schematic partial side cutaway, front elevational and top cross-sectional views of one embodiment of a diving mask 10 provided in accordance with practice of principles of the present invention.

The mask includes a body portion 12 which comprises an inner frame member 14 which retains a tempered glass face plate 16 which has an inner planar surface 18 and an outer planar surface 20. Also provided are left and right tempered glass side plates 22*a* and 22*b* which are retained by the inner frame member and define side ports for peripheral viewing. As is best seen in FIG. 6, the side plates have inner and outer surfaces 24*a*, 24*b* and 26*a*, 26*b*, respectively. The body further comprises a flexible seal 28 for sealably engaging a wearer's face and an outer frame member 30 which secures the seal to the rear periphery of the inner frame member. In an exemplary embodiment, the inner and outer frame members are formed of an acrylic and the seal formed of polyurethane. Other suitable materials may be used as desired.

As is best seen in FIG. 5, the face plate 16 is divided into left and right viewing sections 32*a*, 32*b*, respectively, by a forward extending nose pocket 34 of the flexible seal. To this point, the features described are conventional features presently available on diving masks; for example, masks sold by OCEANIC of San Leandro, Calif. under the trademark PRISMATIC II. In the various illustrated embodiments, such conventional features retain the same reference numerals.

Although the diving mask 10 may be oriented in any position, for purposes of exposition herein, the position of the components of the mask relative to each other are described from the point of view of a wearer of the mask, with the wearer in a vertical, upright position with the left and right sides of the mask corresponding to the wearer's left and right hands.

Turning once again to the embodiment of the invention shown in FIGS. 4, 5 and 6, the mask 10 has horizontally oriented prisms affixed to the face plate 16 for producing a downward rotation of the field of view through the face plate so as to provide enhanced self-inspection capabilities. Specifically, left and right prisms 40*a* and 40*b*, respectively have planar outer surfaces 42*a* and 42*b* affixed to the inner surface 18 of the face plate and, as is best seen in FIGS. 4 and 6, planar inner surfaces 44*a* and 44*b* facing the wearer. The prisms may be affixed to the plates by a suitable transparent bonding material such as LOCTITE Product No. 3301, produced by Loctite Corp. of New York, N.Y. The indices of refraction of the prisms are identified as $n_P$ and the included angles of the prisms, i.e., the angle between the planar inner and outer surfaces, are identified as $\Theta_P$. As is best understood by referring to FIGS. 4 and 6, the inner and outer surfaces of the left and right prisms 40*a* and 40*b* extend substantially downwardly from linear upper edges 46*a* and 46*b* at which they intersect. As is best seen in FIG. 4, the upper edges are oriented horizontally and preferably are below the normal view plane 100 of the wearer. View line 50 indicates the view line between the eyes of the wearer and the face plate exactly at the upper edges of the prisms. Its first continuation line 50′ indicates the view line continuing through the face plate into the ambient water infinitesimally above the upper edges, whereas its second continuation line 50″ indicates the view line through the prisms, face plate and water infinitesimally below the upper edges of the prisms. It can be seen that the view portion above the lines 50, 50′ is unaffected by the presence of the prism. Under Snell's Law, however, the presence of the prisms produces a downward rotation of the view portion below the edges relative to that without the prisms. The maximum downward viewing angle is rotated to a total of $\Theta_L$ although a gap or blind spot having an angle $\Theta_G$ has been produced between lines 50′ and 50″.

In a preferred embodiment, the prisms 40*a* and 40*b* are formed of optical glass BK7, available from Schott Glass Technologies of Duryea, Pa. which has the following properties:

| Spectral Line | Wavelength (nm) | Index-of-Refraction |
|---|---|---|
| Yellow helium | 587.6 | 1.51680 |
| Green mercury | 546.1 | 1.51872 |
| Blue hydrogen | 486.1 | 1.52237 |
| Blue mercury | 435.8 | 1.52669 |

For an internal viewing angle of 55° off of a face plate normal line, a BK7 prism with an included angle $\Theta_P$ of 30° will result in a maximum downward viewing angle $\Theta_L$ in water of 55.4° (486.1 nm), which represents an increase of over 17° in the diver's downward looking line of sight thereby permitting inspection of the diver's person and equipment, e.g., buoyancy compensator straps and controls, weight belt, alternate air source, etc.

As the index of refraction varies with the wavelength of light, different colors of light will be refracted through different angles resulting in a chromatic dispersion. In this example, chromatic dispersion over the blue-green spectrum, however, is within ±0.2°. This may be corrected by redesigning the system to include a secondary correcting prism with a higher index. However, the human eye has been observed to be capable of accommodating this degree of chromatic dispersion and thus such correction is not necessary.

It can be readily seen that, for a given basic mask, the specific positions dimensions and properties of the prisms are largely matters of a designer's choice. If the location of the upper edges of the prisms is selected to preserve a given forward field of view then, to achieve a desired self-inspection view, the designer will chose a prism with the necessary combination of included angle $\Theta_P$ an index of refraction $n_P$.

It would be possible to reduce the gap angle $\Theta_G$ by replacing the single prism with a series of prisms producing progressively greater effective prism angles. This may be accomplished by a series of prisms placed one below another on the inner surface of the face plate, with each prism having a larger angle $\Theta_P$ than the one above, or by a stacked series of narrow angle prisms wherein the outer face of each successive prism is placed against the inner face of the prior prism with successive upper prism edges progressively shifted downward. Instead of a single large gap this would yield a series of smaller gaps between the viewing areas through each prism. The continuous analogue of the stacked series of prisms would be a concave simply curved lens.

Figure 7:
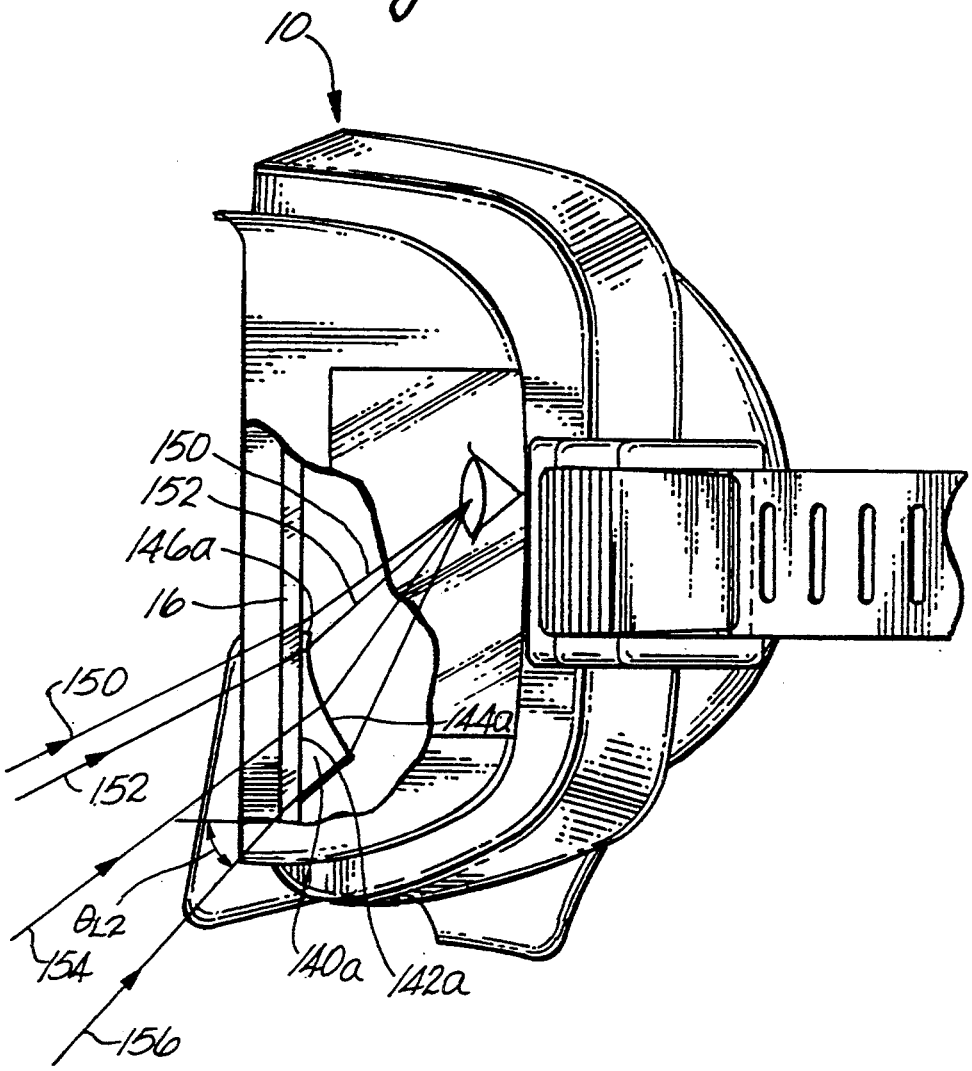
FIG. 7 is a semi-schematic side cross-sectional view of a diving mask featuring a vertical self-inspection simply curved lens according to principles of the present invention.

Turning now to FIG. 7, an embodiment of the mask 10 of the present invention is illustrated wherein the prisms are replaced by simply curved lenses. As shown therein, the lens 140*a* has a planar outer surface 142*a* affixed to the inner surface of the face plate and a concave, simply curved, inner surface 144*a* which further has a uniform radius of curvature.

As is further shown in FIG. 7, the inner and outer surfaces of the lens are joined by an upper edge or surface 146*a*. Adjacent this edge, the outer and inner surfaces 142*a*, 144*a* are substantially parallel to each other. As shown, the upper edge 146*a* is flat, perpendicular to the adjacent inner and outer surfaces and of minimal depth. A view line 150 is the line between the eyes of the wearer and the face plate 16 just above the upper edge of the lens. It continues through the face plate and into the ambient water, refracted according to Snell's law.

A view line 152 is the line between the eyes of the wearer and the lens just below its upper edge. The line continues through the lens 140*a* and face plate 16, refracted according to Snell's law. As the inner and outer surfaces of the lens are parallel adjacent to the upper edge, view lines 150 and 152 are parallel to each other in the water. To the extent that the upper edge of the lens has a definite depth, the view lines 150 and 152 will be separated by a small gap, however, it can be seen that this gap is of negligible consequence when viewing objects more than a few inches in front of the mask. The angle of the upper edge 146*a* relative to the inner and outer lens surfaces may be adjusted to partially reduce the gap. Minimizing the lens thickness adjacent the upper edge or fully integrating the lens into the face plate can further minimize or even eliminate the gap.

As further shown in FIG. 7, view lines 154 and 156 indicate respective views through a middle and a lower portion of the lens. It can be seen that the lens produces a continuous and progressive downward rotation of the view portion below the upper edge of the lens relative to that which would occur without the lens. The maximum downward viewing angle has been rotated to a total of $\Theta_{L2}$ although the progressive rotation leads to a focal distortion which alters the depth of the in-focus field of view. The smaller the radius of curvature of such a lens, the greater its field of view. However, the lens must allow the wearer to focus from the shoulder to the knees, a distance of about 9 inches to about 4 feet, to provide a clear self-inspection view. In a preferred embodiment, the lenses are formed of BK7 optical glass and have a radius of curvature of approximately 1.30 inches.

Figure 8:
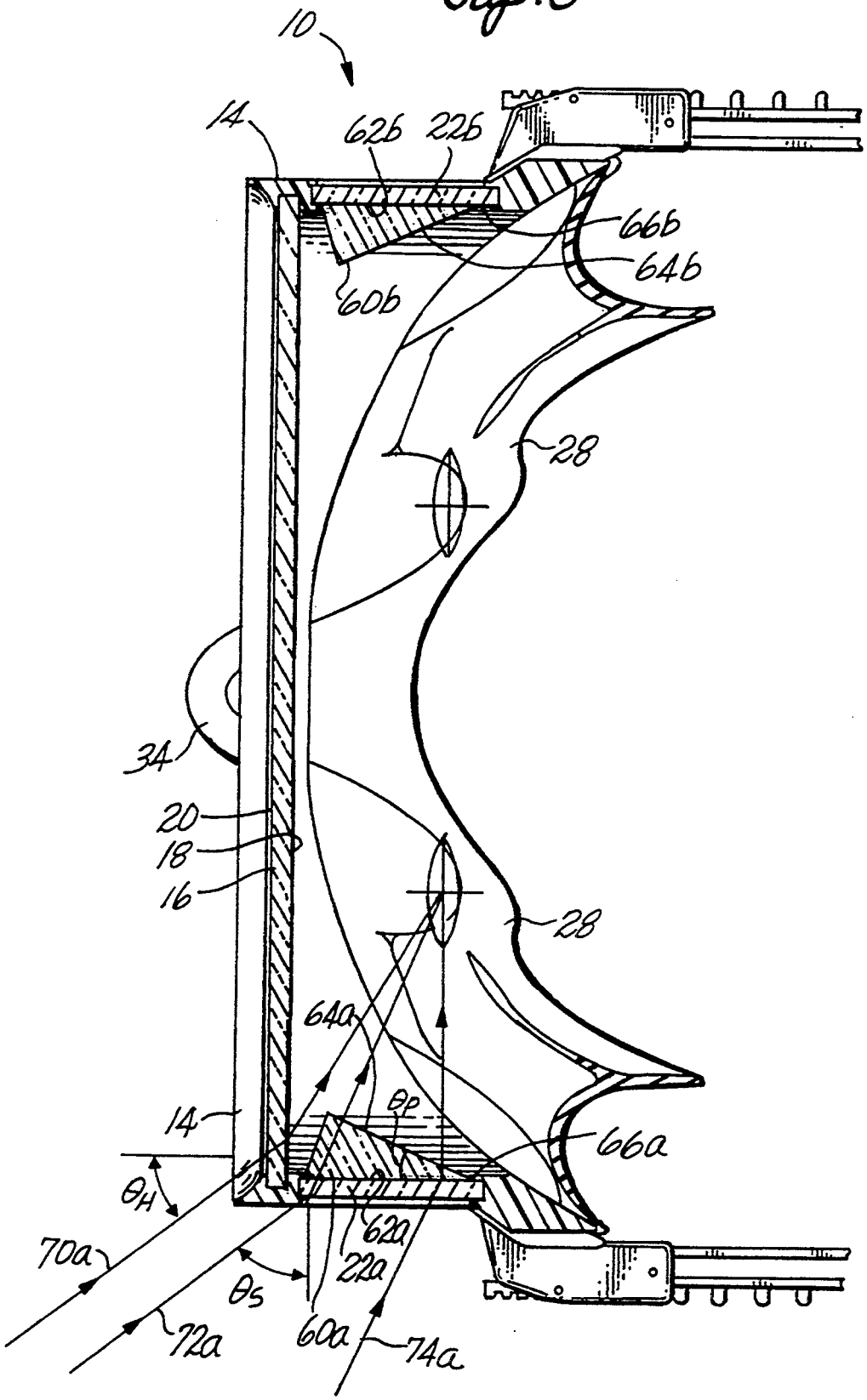
FIG. 8 is a semi-schematic top cross-sectional view of a diving mask featuring side view enhancing prisms according to principles of the present invention.

Turning now to FIG. 8, an embodiment of the mask 10 of the invention incorporates vertically oriented prisms affixed to the side plates of the mask for rotating the fields of view through the side plates so as to establish a substantially continuous field of view through the side plates and face plate. Specifically, left and right prisms 60*a* and 60*b*, respectively, have planar outer surfaces 62*a* and 62*b* affixed to the inner surfaces of the left and right side plates 22*a* and 22*b*, respectively. The planar inner surfaces 64*a* and 64*b* join the planar inner surfaces along vertical linear rear edges 66*a* and 66*b*, respectively. A view line 70*a* is the left-most view line between the left eye of the wearer and the face plate. Continuing through the faceplate and ambient water it has an angle $\Theta_H$ off of the face plate normal which will be approximately 37.7° as noted above. View line 72*a*, the forward-most view line between the left eye of the wearer and the left side plate, passes through the prism 60*a*, the side plate and the ambient water. The view line 72*a* is the forward boundary of the view portion through the left side plate which has been rotated forward by the prism. The rotated total side angle $\Theta_S$ may be chosen as the compliment of $\Theta_H$ so that lines 70*a* and 72*a* are parallel in the water. Accordingly, it can be seen that a small gap or blind spot remains due in part to the presence of the frame structure 14 between the face plate and side plate. At distances more than a few inches from the mask, the importance of the blind spot becomes negligible.

It will be seen that the prism has also led to a forward rotation of the rear-most view line 74*a* thereby decreasing the maximum peripheral view. As was done with the self-inspection enhancement prism of the embodiments shown in FIGS. 4–6, the side-mounted horizontal blind spot reducing prisms 60*a* and 60*b* may be replaced by a simply curved lenses to provide a continuous field of view through the side plates and face plate with a progressive rotation of the field of view through the side plates.

Figure 9:
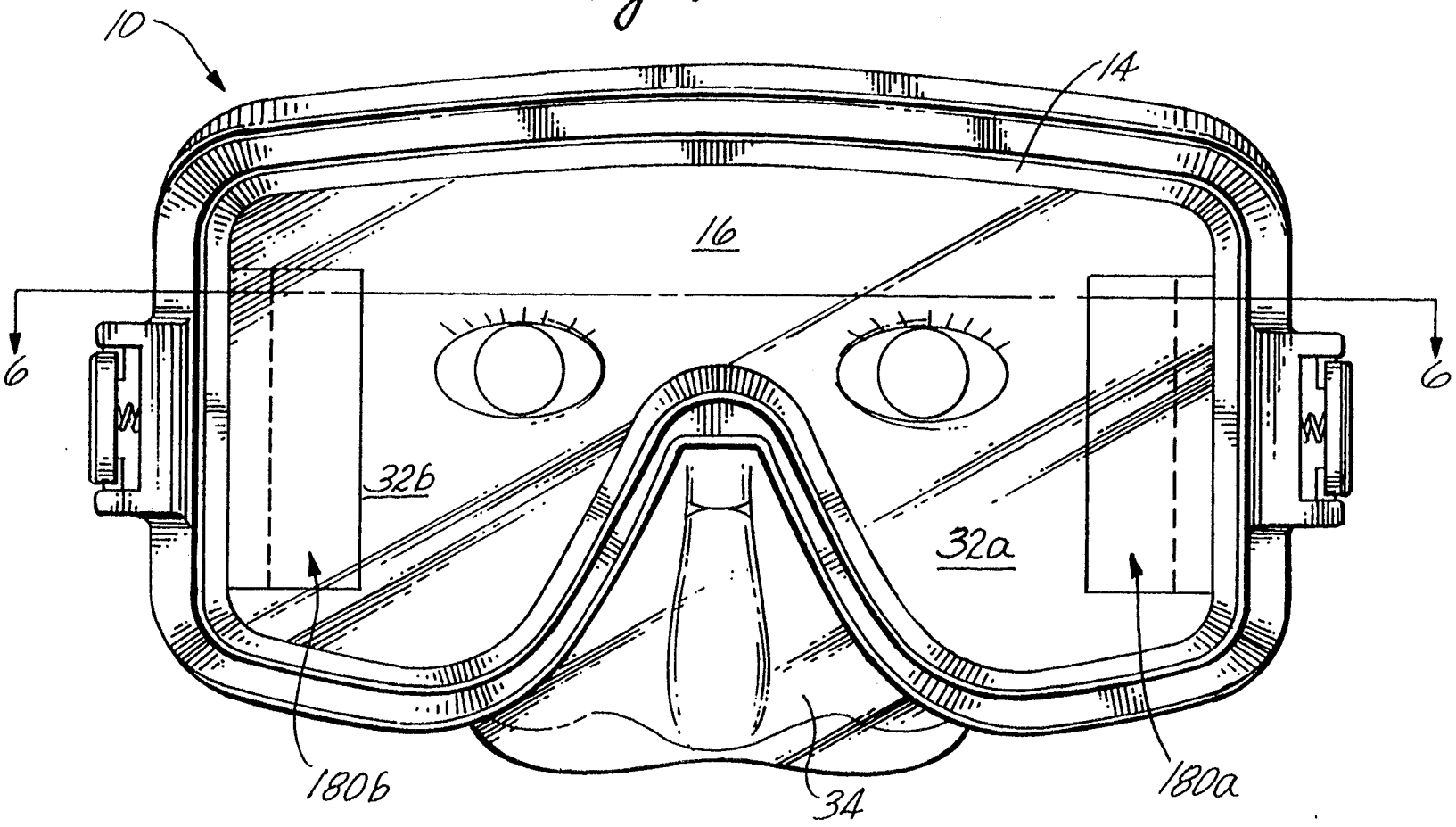
FIG. 9 is a semi-schematic front elevational view of a diving mask featuring side view enhancing simply curved lenses according to principles of the present invention.
Figure 10:
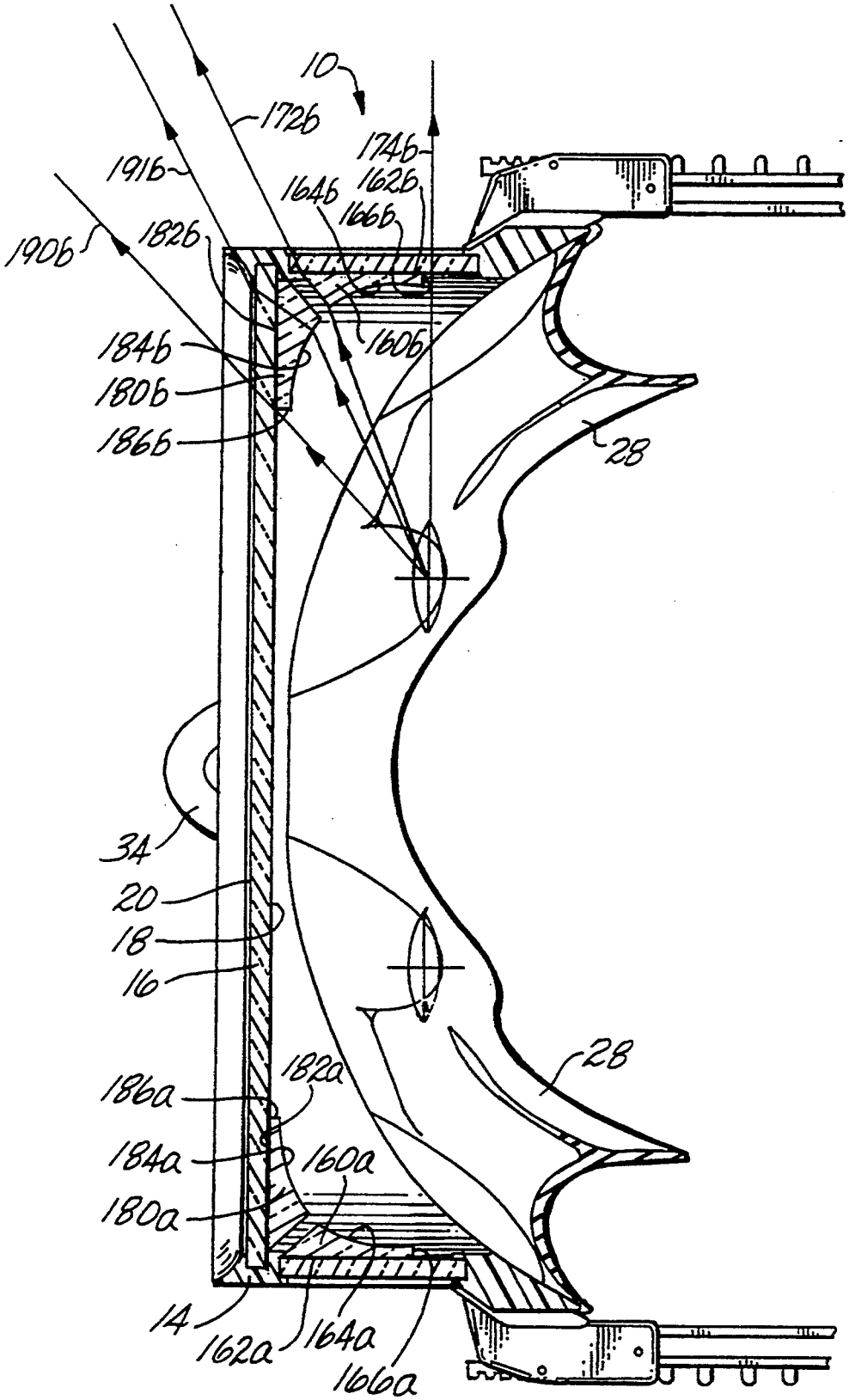
FIG. 10 is a semi-schematic top cross-sectional view of the mask of FIG. 9 taken along line 10—10.
Figure 11:
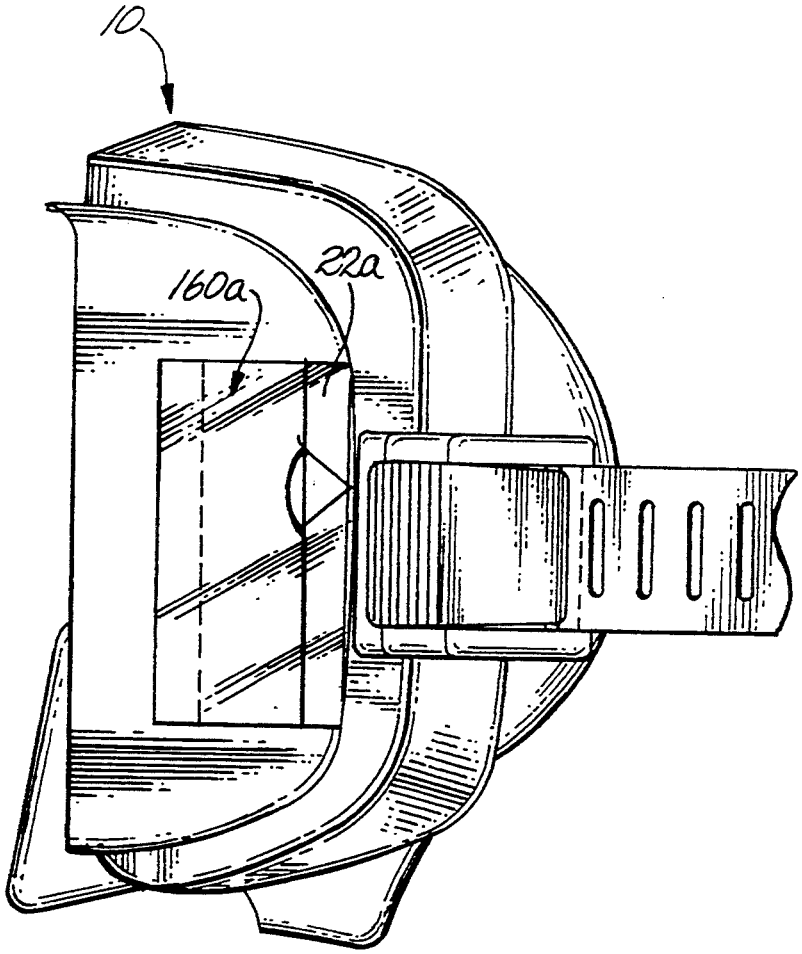
FIG. 11 is a semi-schematic side elevational view of the mask of FIG. 9.

Turning now to FIGS. 9, 10 and 11, a further embodiment of the mask 10 provided in accordance with the present invention combines a side-mounted simply curved lens with another simply curved lens affixed to the inner surface of the face plate 16. The lenses are oriented vertically with their axes of curvature thus parallel. As best shown in FIG. 10, left and right side mounted simply curved lenses 160*a* and 160*b* have planar outer surfaces 162*a* and 162*b* affixed to the inner surfaces of the left and right side plates, respectively. These lenses also have simply curved inner surfaces 164*a* and 164*b* each having a uniform radius of curvature. Left and right front lenses 180*a* and 180*b* have planar outer surfaces 182*a* and 182*b* affixed to the inner surface of the face plate 16 adjacent its left and right vertical edges respectively. The left and right front lenses have simply curved inner surfaces 184*a* and 184*b* which further have a uniform radius of curvature.

The inner and outer surfaces of the side lenses 160*a* and 160*b* are joined by rear edges or surfaces 166*a* and 166*b*, respectively. Adjacent these edges, the inner and outer surfaces are substantially parallel to each other. Similarly, the inner and outer surfaces of the left and right front lenses are joined by inboard edges or surfaces 186*a* and 186*b*, respectively. Adjacent the inboard edges, the inner and outer surfaces are substantially parallel to each other. As shown for the right side of the mask, the right front lens 180*b* provides a continuous and progressive rightward shift of the field of view starting from no shift at its inboard-most view line 190*b* to a maximum shift at its outboard-most view line 191*b*. Similarly, the right side lens 160*b* produces a continuous and progressive shift starting from no shift at its rear-most view line 174*b* to a maximum shift at its forward-most view line 172*b*. The properties and dimensions of the lenses are chosen so that view lines 172*b* and 191*b* are parallel within the water, and separated by a gap caused by the frame structure between the front plate and right side plate. The use of a pair of front and side lenses reduces the need for a high curvature/high index of refraction lens as would be required in a side-only design.

Although the use of lenses introduces focal distortions similar to those produced by the self-inspection lens of FIG. 7, the limited visual acuity in these peripheral regions of view reduces the significance of the focal distortion. Accordingly, a wearer will have a substantially continuous 180° field of view wherein the lateral view portions seen through the lenses are useful primarily for sensing motion, the presence of objects, etc.

Figure 12:
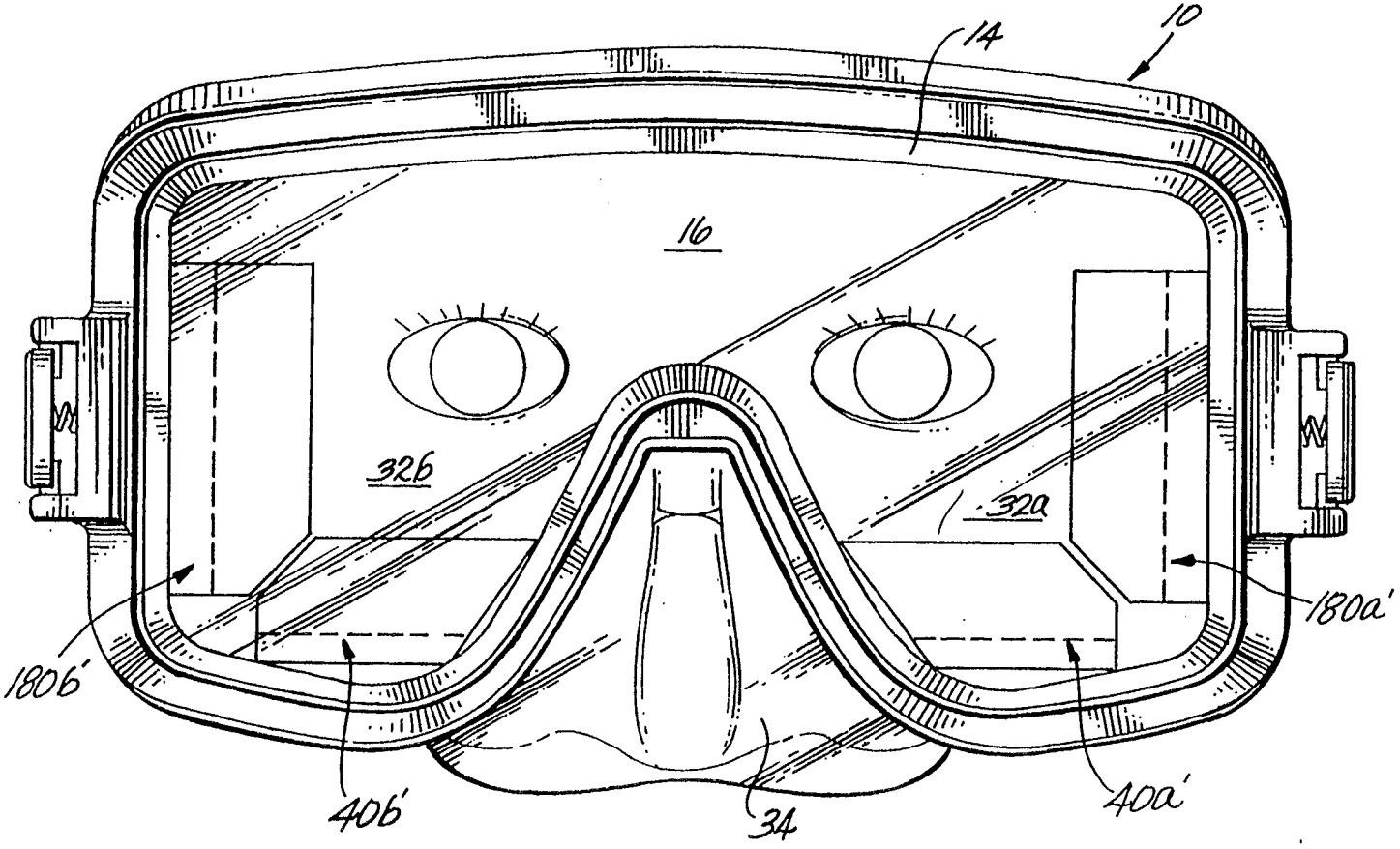
FIG. 12 is a semi-schematic front elevational view of a diving mask featuring both side view enhancing simply curved lenses and a self-inspection prism according to principles of the present invention.

The self-inspection prisms or lenses may be combined with the front and side mounted horizontal view enhancing prisms or lenses, as is shown in an embodiment of FIG. 12. As shown therein, a self-inspection prism 40*b*′ and front horizontal view enhancing lens 180*b*′ are cut and truncated to interfit with each other. The side mounted horizontal view enhancing lenses are unaltered from those shown in FIGS. 10 and 11. Accordingly, the mask of FIG. 12 achieves both the benefits of enhanced self-inspection as well as the expanded and continuous horizontal field of view. It can be seen that the prisms and lenses can be cut to interfit in a variety of manners or may be unitarily formed with each other.

Although the lenses and prisms are described above as being fabricated from optical glass, if desired, other suitable materials such as transparent acrylic may be used. The acrylic polymer useful in accordance with the present invention has an index of refraction and chromatic dispersion comparable to that of an optical glass such as BK7. When acrylic is used, the prisms or lenses could be formed unitarily with the mask frame.

Figure 13:
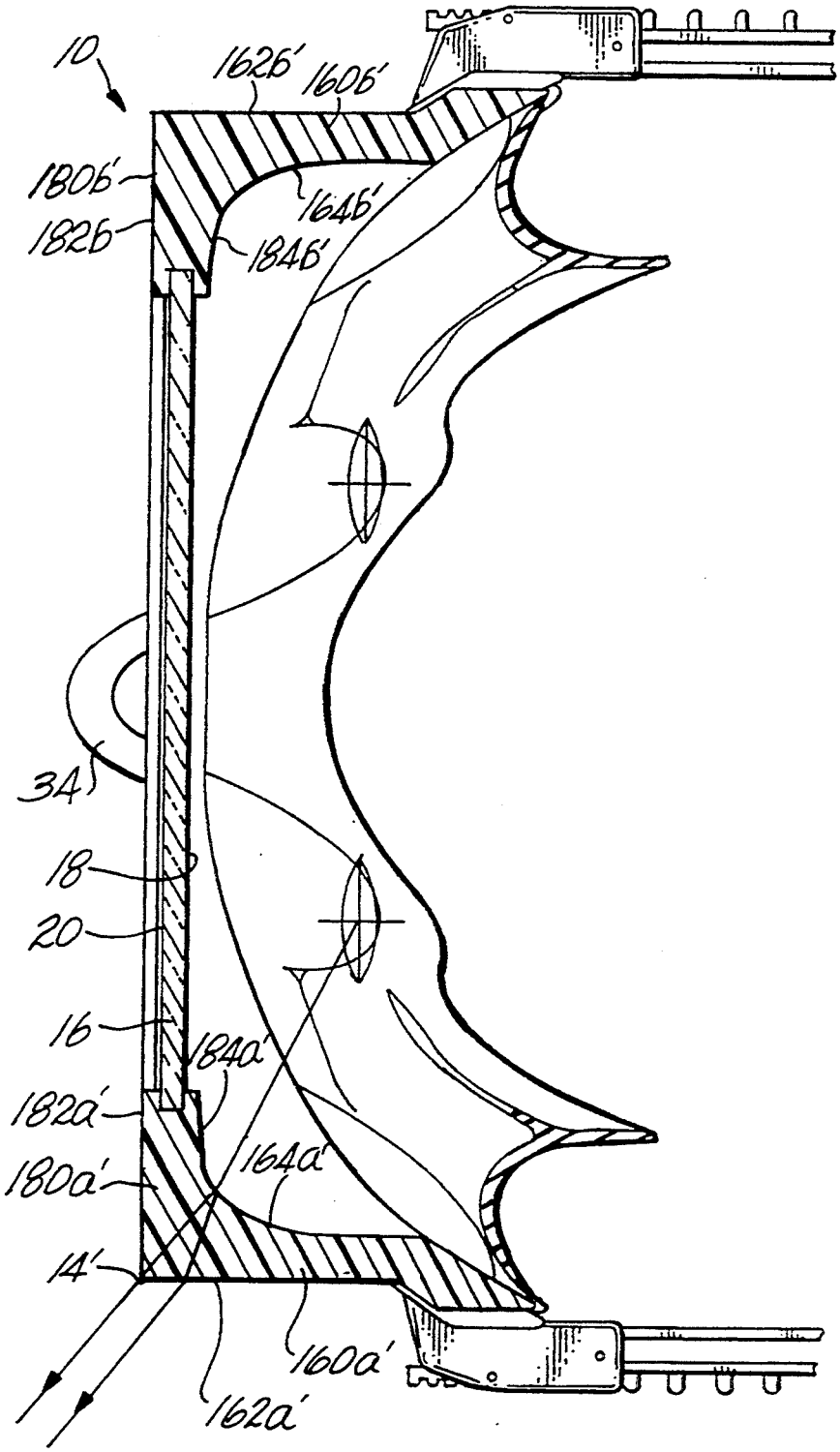
FIG. 13 is a semi-schematic top cross-sectional view of a diving mask featuring side view enhancing simply curved lenses unitarily formed with the mask frame according to principles of the present invention.

Turning now to FIG. 13, there is shown a mask 10 wherein side view enhancing lenses are formed unitarily with the inner mask frame member 14′. As shown therein, the inner frame member has left and right side lens portions 160*a*′ and 160*b*′ having planar outer surfaces 162*a*′ and 162*b*′ exposed to the ambient water at the left and right sides of the mask, respectively. These lens portions also have simply curved inner surfaces 164*a*′ and 164*b*′, respectively, each having a uniform radius of curvature. The inner frame member further has left and right front lens portions 180*a*′ and 180*b*′ having forward facing planar outer surfaces 182*a*′ and 182*b*′ exposed to the ambient water. These lens portions further have simply curved inner surfaces 184*a*′ and 184*b*′ each having a uniform radius of curvature. Accordingly, although the field of view through the lenses passes directly into the water, it can be seen that the lenses alter the field relative to what it would be with a face plate and side plates present instead of the lenses. As noted previously, self-inspection prisms or lenses could be added to this embodiment of the invention as well, either as separate elements or as a further portion of a unitary frame member.

The illustrated prisms and simply curved lenses of FIGS. 4–13 are of uniform cross-section at least over substantial portions. Their outer surfaces defined by said cross-sections are therefore general mathematical cylinders and the prisms and lenses can therefore be generically described as "cylindrical solids". Thus it can be seen that the prisms or lenses are mounted on the viewing plates in an orientation parallel thereto so that the view lines pass through the lateral surfaces of the prisms or lenses.

Figure 14:
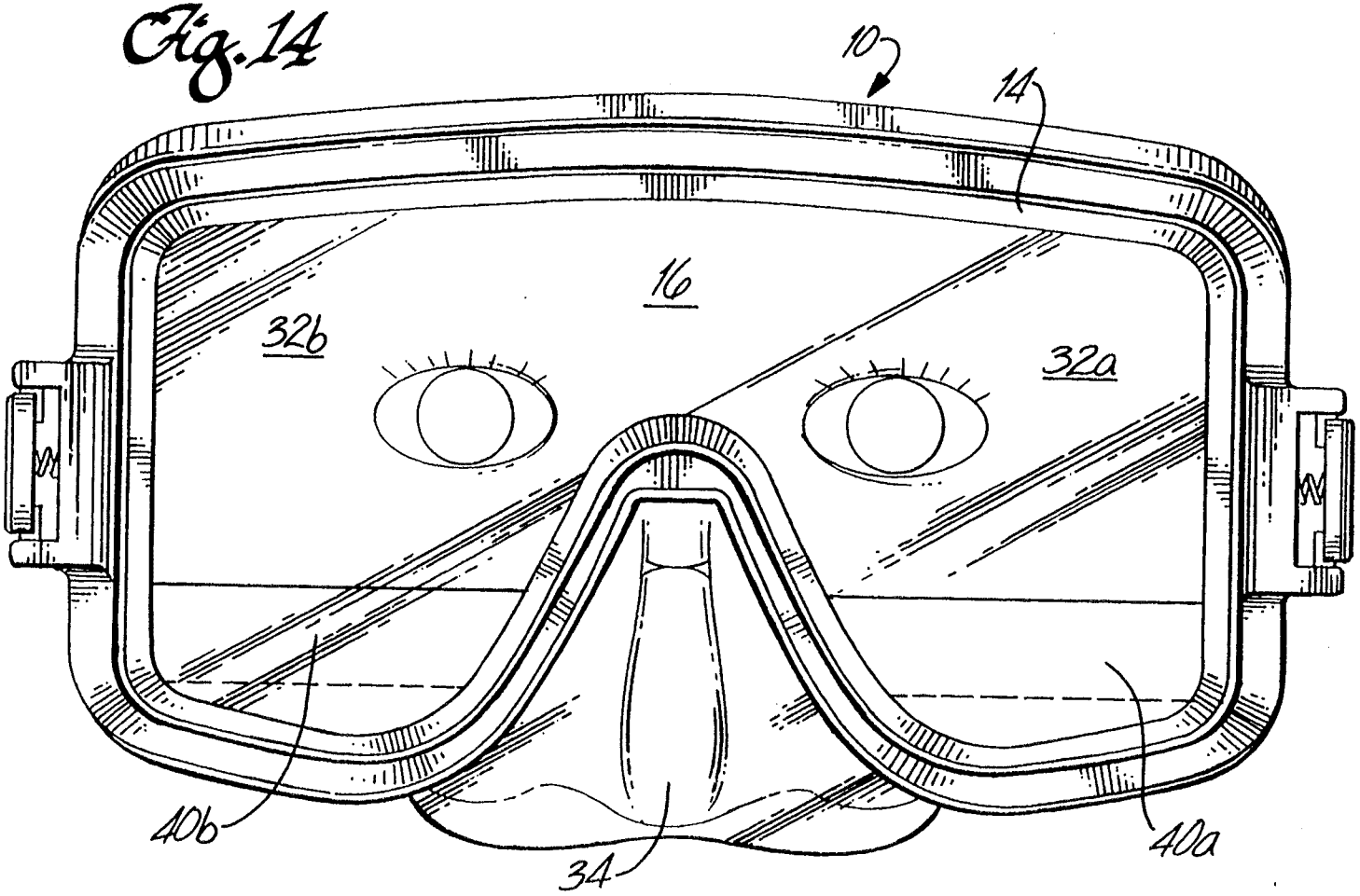
FIG. 14 is a semi-schematic front elevational view of a diving mask featuring contoured self-inspection prisms according to principles of the present invention.

Turning to FIG. 14, in yet another embodiment of the mask 10 provided in accordance with the present invention, the prisms or lenses may be cut or otherwise fabricated to match the contour of the face plate periphery. Specifically shown are self-inspection prisms 40*a*″ and 40*b*″ which have a lower contour matching that of the lower portion of the face plate. Due to the contouring, the prisms are no longer general mathematical cylindrical solids. Such contoured prisms and lenses remain, however, refracting bodies having a first planar surface and a second simply curved surface which is at least in part at an acute angle greater than 0° from the first surface. In the case of the prisms, the simply curved surface has an infinite radius of curvature.

Although the illustrated embodiments are applied to a particular style and model of diving mask, the invention is equally applicable to other styles of mask. The illustrated mask is substantially divided into left and right viewing sections by a portion of the flexible seal which accommodates the wearer's nose. In other masks, the face plate may extend in front of the nose, or the face plate may be formed in two sections or the face plate and body formed each in two separate sections so as to form a pair goggles. In varying forms, the present invention may be applied to any such mask, including any physically appropriate combination of prisms or lenses for enhanced self-inspection or enhanced and continuous horizontal field of view.

The above-described embodiments of the invention are considered to be preferred and illustrative of the inventive concept; the scope of the invention is not to be restricted to such embodiments. Various and numerous other arrangements, uses of materials, and fabrication techniques may be devised by one skilled in the art without departing from the spirit and scope of this invention.

I claim:

1. A mask for underwater use comprising:

a body configured to sealably engage a wearer's face;

at least one transparent viewing plate supported by the body and having inner and outer surfaces; and a transparent cylinder mounted on at least one such viewing plate in an orientation parallel thereto for refractively altering a view through said viewing plate.

2. The mask of claim 1 wherein the transparent cylinder is a prism having first and second planar surfaces at an acute angle to each other.

3. The mask of claim 2 wherein the first planar surface of the prism is affixed to the inner surface of the viewing plate.

4. The mask of claim 3 wherein the first and second planar surfaces of the prism intersect along a linear edge which is aligned substantially horizontally and below a normal view plane of the wearer.

5. The mask of claim 1 wherein the transparent cylinder has a first planar surface and a second concave, simply curved, surface.

6. The mask of claim 5 wherein the viewing plate is a face plate and the transparent cylinder is oriented substantially vertically and mounted on the inner surface of the face plate.

7. The mask of claim 5 wherein the viewing plate is a side plate and the transparent cylinder is oriented substantially vertically and mounted on the inner surface of the side plate.

8. The mask of claim 7 wherein the mask further comprises a face plate and the cylinder has curvature for providing a substantially continuous field of view through the face plate and the side plate.

9. The mask of claim 1 wherein the mask comprises front and side transparent viewing plates and the transparent cylinder has curvature for reducing a blind spot between said front and side transparent viewing plates.

10. A mask for underwater use comprising:

a body configured to sealably engage a wearer's face;

a transparent viewing plate supported by the body and having inner and outer surfaces; and a transparent body mounted on said viewing plate for refractively altering a view through the viewing plate, the transparent body having a first planar surface and a simply curved second surface, which second surface is at least in part at an acute angle to the first surface.

11. The mask of claim 10 wherein the second surface of the transparent body is planar.

12. The mask of claim 11 wherein the first surface of the transparent body is affixed to the inner surface of the viewing plate.

13. The mask of claim 12 wherein the viewing plate is a face plate and the first and second planar surfaces of the transparent body intersect along a linear edge which is oriented substantially horizontally and positioned below a normal view plane of the wearer, said first and second planar surfaces extending substantially downwardly from the linear edge.

14. The mask of claim 13 wherein the face plate has left and right viewing sections and the first surface of the transparent body is affixed to the inner surface of the face plate along the left viewing section, which mask further comprises a second transparent body having a planar first surface affixed to the inner surface of the face plate along the right viewing section and a planar second surface at an acute angle to the first surface, said first and second surfaces of the second transparent body intersecting along a second linear edge which is oriented substantially horizontally and positioned below the normal view plane of the wearer.

15. The mask of claim 10 wherein the second surface of the transparent body is concave and of a uniform radius of curvature.

16. A mask for underwater use comprising:

a body configured to sealably engage a wearer's face;

a transparent face plate supported by the body and having inner and outer surfaces; and a transparent body connected to said face plate for refractively altering the view through the transparent body, the transparent body having a first planar surface and a simply curved second surface, which second surface is at least in part at an acute angle to the first surface.

17. The mask of claim 16 wherein the second surface of the transparent body is planar.

18. The mask of claim 17 wherein the transparent body is oriented substantially horizontally and positioned below a normal view plane of the wearer.

19. The mask of claim 16 wherein the transparent body is oriented substantially vertically with its first planar surface oriented substantially parallel to the face plate.

20. The mask of claim 19 further comprising a transparent side plate, wherein a second transparent body having a first planar surface and a simply curved second surface is mounted on the side plate, the second surface being at least in part at an acute angle to the first surface, which second body is oriented substantially vertically on the side plate, with its first planar surface oriented substantially orthogonal to the face plate.

21. The mask of claim 20 wherein a resultant field of view through the two transparent bodies is substantially continuous.

22. The mask of claim 16 wherein the transparent body is unitarily formed with a frame member of the mask body.

23. The mask of claim 22 wherein the transparent body further comprises a third planar surface and a simply curved fourth surface, which fourth surface is at least in part at an acute angle to the third surface, which, third surface is oriented substantially orthogonal to the face plate.

24. A mask comprising:

a body configured to sealably engage a wearer's face;

a transparent face plate supported by the body and having inner and outer planar surfaces and left and right sides;

left and right transparent side plates, each having inner and outer surfaces, supported by the body adjacent the left and right sides of the face plate, respectively, and oriented substantially orthogonal to the face plate; and a transparent body having a first planar surface and a simply curved second surface, which second surface is at least in part at an acute angle to the first surface, said first planar surface affixed to one of the side plates.

25. The mask of claim 24 wherein the transparent body is a lens and its second surface is a concave surface.

26. The mask of claim 25 wherein the first surface of the lens is affixed to the inner surface of said one of the side plates and the concave surface faces substantially inward from said one of the side plates.

27. The mask of claim 26 wherein the concave surface has a uniform radius of curvature.

28. The mask of claim 26 further comprising a second simply curved lens having a planar first surface which is affixed to the inner surface of the face plate and having a concave second surface facing substantially inward from the inner surface of the face plate.

29. The mask of claim 28 wherein the second simply curved lens is located substantially adjacent said one of the side plates.

30. The mask of claim 29 further comprising a third transparent body having a first planar surface and a simply curved second surface, which second surface is at least in part at an acute angle to the first surface, said first planar surface affixed to the inner surface of the face plate with said first and second surfaces of the third transparent body meeting in a substantially horizontal edge located below the normal view plane of the wearer.

31. The mask of claim 30 wherein the third transparent body is a prism, the second surface of which is a planar surface.

32. The mask of claim 30 wherein the concave surfaces of the first and second lenses each have uniform radii of curvature and axes of curvature parallel to each other.

33. The mask of claim 32 wherein the first and second lenses provide therebetween a substantially continuous underwater field of view.

34. The mask of claim 24 wherein the transparent body is a prism, the second surface of which is a planar surface and the first surface of which is affixed to one of the surfaces of said one of the side plates.

35. The mask of claim 34 wherein the first and second planar surfaces of the prism intersect along a linear edge which is oriented substantially vertically, said surfaces extending substantially forward from the edge.

36. A mask comprising:

a body for engaging a wearer's face;

a transparent face plate supported by the body, wherein said face plate has inner and outer planar surfaces and left and right viewing sections; and first and second transparent prisms, each of which has a first planar surface, wherein the first planar surface of the first such prism is affixed to the inner surface of the right viewing section, and the first planar surface of the second such prism is affixed to the inner surface of the left viewing section.

37. The mask of claim 36 additionally comprising left and right transparent side plates, wherein each such side plate is supported by the body adjacent the left and right viewing sections, respectively, such side plates oriented substantially orthogonal to the face plate.

38. The mask of claim 37 additionally comprising third and fourth transparent prisms, each having a first planar surface affixed to each of the side plates on the inner surface of said side plate.

* * * * *